United States Patent [19]

Burton et al.

[11] Patent Number: 4,631,139

[45] Date of Patent: Dec. 23, 1986

[54] CORROSION INHIBITING METAL WORKING FLUID

[75] Inventors: James R. Burton, Groves; David J. Kushner, Beaumont, both of Tex.

[73] Assignee: Texaco Inc., White Plains, N.Y.

[21] Appl. No.: 763,504

[22] Filed: Aug. 8, 1985

[51] Int. Cl.[4] ..... C10M 173/00

[52] U.S. Cl. ..... 252/49.3; 72/42; 252/49.5

[58] Field of Search ..... 252/49.3, 49.5; 72/42

[56] References Cited

U.S. PATENT DOCUMENTS

| | | | |
|---|---|---|---|
| 4,177,155 | 12/1979 | Popplewell et al. | 252/49.3 |
| 4,313,837 | 2/1982 | Vukasovich et al. | 252/49.3 |
| 4,329,249 | 5/1982 | Forsberg | 252/49.3 |
| 4,342,658 | 8/1982 | Tincher et al. | 252/49.3 |
| 4,368,133 | 1/1983 | Forsberg | 252/49.3 |
| 4,379,063 | 4/1983 | Williams | 252/49.3 |
| 4,402,839 | 9/1983 | Davis et al. | 252/49.3 |
| 4,425,248 | 1/1984 | Piotrowski et al. | 252/49.3 |
| 4,447,348 | 5/1984 | Forsberg | 252/49.3 |
| 4,452,712 | 6/1984 | Laemmle | 242/49.3 |

FOREIGN PATENT DOCUMENTS

| | | | |
|---|---|---|---|
| 995708 | 6/1965 | United Kingdom | 252/49.3 |

*Primary Examiner*—William R. Dixon, Jr.
*Assistant Examiner*—Cynthia A. Prezlock
*Attorney, Agent, or Firm*—Jack H. Park; Kenneth R. Priem; Richard A. Morgan

[57] ABSTRACT

The invention is a corrosion inhibiting water-based machining fluid comprising a synergistic combination of a 2-heptyl-1-ethoxypriopionic acid imidazoline, sodium salt; free amine and a mixture of an amine salt of $C_8$ to $C_{14}$ dicarboxylic acids.

18 Claims, No Drawings

CORROSION INHIBITING METAL WORKING FLUID

BACKGROUND OF THE INVENTION

1. Field of the Invention

This invention is a water based machining fluid with a synergistic rust inhibiting combination of an amphoteric imidazole derivative, a free amine and amine salts of dicarboxylic acids.

2. Description of the Prior Art

Aqueous systems have been preferred for many machine applications which are subject to high heat or sparks. Such applications include hydraulic fluids for use in systems involving a high risk of fire, and in quenchants used to cool heated metals during various metal working processes where the hot metals can ignite hydrocarbon based quenchants. However, aqueous systems are corrosive toward metal, particularly ferrous metal.

In a previously used aqueous system which is non corroding to metals, an inorganic nitrite, such as sodium nitrite, was used to impart improved corrosion inhibition to the aqueous system. However, nitrites are somewhat toxic and in recent years there has been a movement toward the removal of nitrites and the replacement with other materials to impart corrosion inhibition to the aqueous system.

U.S. Pat. Nos. 4,450,088 and 4,452,758 describe aqueous antifreeze compositions comprising 2-heptyl-1-ethoxypropionic acid imidazoline, sodium salt and triethanolamine.

SUMMARY OF THE INVENTION

A water based composition, non corroding to metals, has now been discovered. The composition comprises three constituents in an effective synergistic amount. The first constituent is an amphoteric imidazoline derivative consisting of 2-heptyl-1-ethoxypropionic acid imidazoline, sodium salt in an amount of at least about 2 wt %. The second constituent is diethanolamine, triethanolamine or mixtures thereof in an amount of about 20 to 27 wt %. The third constituent is the diethanolamine or triethanolamine salt of a $C_8$ to $C_{14}$ dicarboxylic acid or mixtures thereof. The third constituent is in a critical ratio to the second constituent. The weight ratio of diethanolamine or triethanolamine salt of a selected dicarboxylic acid to free amine of the second constituent is about 3:8 to 5:8. The most preferred synergistic amount is a weight ratio of 4:8 amine salt to free amine.

The resultant synergistic composition provides ferrous corrosion inhibition at high dilution; exceptionally good wetting and detergency; and excellent hard water compatibility. These characteristics are best utilized as a synthetic water-based machining fluid. The performance and marketability of the composition in the preferred embodiment are enhanced by addition of supplemental ingredients, e.g. wetting agents, bactericide and dye.

DESCRIPTION OF THE PREFERRED EMBODIMENTS

A water-based machining fluid formulation comprising a synergistic three component rust inhibitor composition in aqueous medium has been found that provides superior rust inhibition and hard water compatibility compared to a sampling of commercial water-based machining fluids. The diluted formulation finds application as a coolant and lubricant for grinding and high-speed machining of cast iron and ferrous metals. The excellent rust inhibition characteristics allow higher dilutions to be used, thereby improving cooling properties and reducing operational costs. Hard water compatibility improves coolant clarity, facilitates operator viewing, and prevents flocculation or sedimentation which can cause filter plugging or reduced performance from depletion of active ingredients. Other performance characteristics such as fluid evaporation residues, high reserve alkalinity and excellent wetting ability establish the suitability of the formulation for these applications.

The 2-heptyl-1-ethoxypropionic acid imidazoline, sodium salt comprises at least 2 wt % of the concentrate. Below this amount, composition properties drop off. The upper limit for the imidazoline derivative is not so critical. However, the compound imparts an odor to the composition which does not enhance the product and therefore higher concentrations are not preferred. Excessive concentrations of the imidazole derivative were found to cause a hazy appearance, an undesirable characteristic in a machining fluid where visual inspection of the wetted metal surface as well as the metal working element (e.g. cutting element, drilling element, grinding element, scoring element) is integral to the metal machining process e.g. cutting, grinding, drilling, quenching. Clarity may be maintained within a broad temperature range by adding a small amount of a surfactant, e.g. a polyethoxylated nonylphenol, to the composition.

The amount of free amine (diethanolamine, triethanolamine or mixtures thereof) is specified by the properties imparted to the composition. At the low end, at least about 20 wt % free amine is required to impart reserve alkalinity to the fluid to preserve its machining fluid properties over the use life. At the upper end, no further improvement in rust inhibition is imparted to the composition at free amine concentrations over 27 wt %.

The amount of diethanolamine or triethanolamine salt of a dicarboxylic acid was found to be critical. Synergistically, it was found that a weight ratio of 4:8 amine salt of a dicarboxylic acid: free amine, yielded the best results. When the ratio dropped below about 3:8 rust protection rapidly dropped off. Curiously, ratios above 5:8 yielded less favorable results.

The composition is prepared by stirring the constituents in a stainless steel kettle at 60° to 100° F. These fluids are shipped as concentrates. Before use they are diluted with water, typically 20 to 30 parts water per part concentrate. The ultimate dilution is a function of tool life and rust inhibition and some users have found that dilutions of 50 to 60 parts water per part concentrate is a cost effective use strength for their applications.

EXAMPLE I

Laboratory performance test data for water dilutions of the present concentrate are compared in Table I to four commercial water based machining fluids. The invention fluid shows significantly higher rust/no rust dilutions than the best competitive products in the Chip Rust Test. In the Chip Rust Test, approximately 15 ml portions of clean, dry cast iron chips were soaked in sequential dilutions (20:1, 30:1, etc.) of the test fluid. The fluid was drained and the chips were spread evenly over the bottom of a 100 mm diameter Petri dish. After drying for 16 hours, the chips were rated for rust. The rusting of 11 or more chips at a given dilution constituted a failure of the fluid at that dilution. Visual evaluation of hard water compatibility indicates the inventive fluid is on average superior to commercially available competative fluids. Both characteristics are primarily due to the unique rust inhibitor combination employed.

The Four Ball Wear Test determines wear preventive characteristics in sliding steel-on-steel applications carried out as described in ASTM D-2266.

TABLE I

| Composition, % weight | A | B | C | D | E |
|---|---|---|---|---|---|
| Water | 45.40 | 57 | 56 | 56 | 55 |
| Aqualox ® 232 | 19.00 | | | | |
| Triethanolamine | 27.00 | | | | |
| Monateric ® 1000 (50% active) | 4.00 | | | | |
| Surfonic ® N-95 | 3.00 | | | | |
| 49% Caustic Soda Solution | 1.50 | | | | |
| Vancide ® TH | 0.10 | | | | |
| Green Dye | 300 PPM | | | | |
| Triethanolamine Borate | | 37 | 24 | | 45 |
| Triethanolamine Rosinote | | | | 44 | |
| Triethanolamine | | | 13 | | |
| Other | | 6 | 7 | | |
| TESTS | | | | | |
| Chip Rust Test maximum no-rust dilution | 80:1 | 20:1 | 40:1 | 40:1 | 40:1 |
| Hard Water Compatibility 10:1 dilution, 600 PPM hardness 7 days, ambient temperature | No turbidity or sediment | No turbidity or sediment | No turbidity or sediment | turbid mod. sediment | slight sediment |
| Evaporation Residues 10:1 dilution, 600 PPM hardness | Fluid, non-tacky | Sticky, resinous | Fluid, non-tacky | Greasy, non-tacky | Sticky, resinous |
| Wetting, visual, 80:1 dilution | | | | | |
| on cast-iron | Excellent | Poor | Good | Good | Fair |
| on plexiglas | Very Good | Poor | Poor | Good | Poor |
| pH, concentrate | 9.25 | 10.52 | 9.86 | 8.55 | 10.07 |
| Reserve Alkalinity, meq HCl/ml | 2.77 | 3.22 | 2.06 | 1.00 | 3.08 |
| 4-Ball Wear Test 1 Hr., 75° C., 600 RPM, 1 Kg. 10:1 dilution, scar dia, mm | 0.31 | 0.92 | 0.27 | 0.37 | 1.08 |

A. Inventive fluid
B. Houghto-Grind 60 ®, E. F. Houghton & Co.
C. Sunicool EP, Sun Oil Co.
D. Cimcool ®, Cincinnati Millicron
E. Cimfree ®, Cincinnati Millicron

EXAMPLE II

Although each additive is known individually as a rust inhibitor, it was heretofore not known that the claimed combination of these additives synergistically improves rust inhibition as measured by the Chip Rust Test, shown by the test data presented in Tables II and III. In Table II at equal 40 wt % additive dosages, a combination of the three inhibitors provided significant improvement in cast-iron chip corrosion inhibition over each additive taken individually. In Table III the same phenomenon was demonstrated with the components formulated at a constant 43.6 wt % active ingredient dosage. Optimization of relative dosages of the three inhibitors and addition of supplemental performance additives yielded a formulated product which exhibited the performance improvements described herein.

TABLE II

| Composition, wt % | F | G | H | I | J |
|---|---|---|---|---|---|
| Water | 60.0 | 60.0 | 60.0 | 60.0 | 45.4 |
| Aqualox ® 232[a] | 40.0 | — | — | 10.0 | 19.0 |
| Triethanolamine[b] | — | 40.00 | — | 10.0 | 27.0 |
| Monateric ® 1000[c] | — | — | 40.0 | 20.0 | 4.0 |
| Surfonic ® N-95[d] | — | — | — | — | 3.0 |
| 49% Caustic Soda[e] | — | — | — | — | 1.5 |
| Vancide ® TH[f] | — | — | — | — | 0.1 |
| Green Dye | — | — | — | — | 300 PPM |

TABLE II-continued

| Composition, wt % | F | G | H | I | J |
|---|---|---|---|---|---|
| TESTS | | | | | |
| Chip Rust Test | | | | | |
| Lowest rusting dilution | 40:1[g] | 40:1[g] | 40:1[g] | 60:1 | 90:1 |
| High no-rust dilution | — | — | — | 50:1 | 80:1 |
| % chips rusted at rusting dilution | 10% | 50% | 100% | <10% | 20% |

(10% rusted chips is considered substantial rusting)
[a]Aqualox ® 232: triethanolamine salt of a mixture of $C_8$–$C_{14}$ dicarboxylic acids; 97% linear, 3% indeterminate - 77 wt % active
[b]includes up to 15% mono- and diethanolamine - 100% active
[c]Monateric ® 1000: 2-heptyl-1-ethoxypropionic acid imidazoline, sodium salt - 50 wt % active
[d]Surfonic ® N-95: 9.5 molar ethoxylate of nonylphenol, improves product clarity
[e]increases pH to about 9 to 9.5
[f]Vancide ® TH: bactericide; hexahydro triethyl-triazine
[g]lowest dilution run.

TABLE III

| Composition, wt % | K | L | M | N |
|---|---|---|---|---|
| Water | 43.4 | 56.4 | 12.8 | 50.0 |
| Aqualox ® 232 | 56.6 | — | — | 19.0 |
| Triethanolamine | — | 43.6 | — | 27.0 |
| Monateric ® 1000 | — | — | 87.2 | 4.0 |
| TESTS | | | | |
| Chip Rust Test Lowest rusting dilution* | 20:1[g] | 20:1[g] | 20:1[g] | 60:1 |

*A different set of cast iron chips was used for this test than those used in Table III.
[g]lowest dilution run The principle of the invention and the best mode contemplated for applying the principle have been described. It is to be understood that the foregoing is illustrative only and that the other means and techniques can be employed without departing from the true scope of the invention defined in the following claims. For example, all effective water dilutions of the concentrate are envisioned.

What is claimed is:

1. A water-base composition which is non corroding to metals in contact therewith comprising an effective corrosion inhibiting amount of a concentrate comprising:

A. 2-heptyl-1-ethoxypropionic acid imidazoline, sodium salt in an amount of at least about 2 wt %;

B. a free amine selected from the group consisting of diethanolamine, triethanolamine and mixtures thereof in an amount of about 20 to 27 wt %; and C. an amine salt of a dicarboxylic acid selected from the group consisting of the diethanolamine and triethanolamine salts of a $C_8$ to $C_{14}$ dicarboxylic acid and mixtures thereof in an amount such that the weight ratio of amine salt to free amine is about 3:8 to 5:8.

2. The water-base composition of claim 1 wherein in the concentrate the weight ratio of amine salt to free amine is about 4:8.

3. The water-base composition of claim 1 wherein in the concentrate the 2-heptyl-1-ethoxy propionic acid imidazole, sodium salt is in an amount of about 2 wt %.

4. The water-base composition of claim 1 wherein in the concentrate the dicarboxylic acid is a linear dicarboxylic acid.

5. The water-base composition of claim 1 wherein in the concentrate the dicarboxylic acid is a mixture of linear dicarboxylic acids.

6. The water-base composition of claim 1 wherein in the concentrate the free amine is triethanolamine and the amine salt is a triethanolamine salt.

7. The water-base composition of claim 1 wherein the concentrate additionally comprises an ethoxylated nonylphenol.

8. A water-based composition which is non corroding to metals in contact therewith comprising an effective corrosion inhibiting amount of a concentrate comprising:

A. 2-heptyl-1-ethoxypropionic acid imidazoline, sodium salt in an amount of at least about 2 wt %;

B. triethanolamine is an amount of about 20 to 27 wt %; and

C. the triethanolamine salt of a dicarboxylic acid selected from the group consisting of a linear $C_8$ to $C_{14}$ dicarboxylic acid and mixtures thereof in an amount such that the weight ratio of triethanolamine salt to triethanolamine is about 4:8.

9. The composition of claim 7 which additionally comprises in the concentrate a polyethoxylated nonylphenol.

10. In a metal machining process comprising a metal working element, wherein the improvement comprises contacting the metal working element with a water-base composition comprising an effective corrosion inhibiting amount of concentrate comprising:

A. 2-heptyl-1-ethoxypropionic acid imidazoline, sodium salt in an amount of at least about 2 wt %;

B. a free amine selected from the group consisting of diethanolamine, triethanolamine and mixtures thereof in an amount of about 20 to 27 wt %; and C. an amine salt of a dicarboxylic acid selected from the group consisting of the diethanolamine and triethanolamine salts of a $C_8$ to $C_{14}$ dicarboxylic acid and mixtures thereof in an amount such that the weight ratio of amine amine salt to free amine is about 3:8 to 5:8.

11. The metal machining process of claim 10 wherein in the concentrate the weight ratio of amine salt to free amine is about 4:8.

12. The metal machining process of claim 10 wherein in the concentrate the 2-heptyl-1-ethoxy propionic acid imidazole, sodium salt is in an amount of about 2 wt %.

13. The metal machining process of claim 10 wherein in the concentrate the dicarboxylic acid is a linear dicarboxylic acid.

14. The metal machining process of claim 10 wherein in the concentrate the dicarboxylic acid is a mixture of linear dicarboxylic acids.

15. The metal machining process of claim 10 wherein in the concentrate the free amine is triethanolamine and the amine salt is a triethanolamine salt.

16. The metal machining process of claim 10 wherein in the concentrate additionally comprises a polyethoxylated nonylphenol.

17. In a metal machining process comprising a metal working element, wherein the improvement comprises contacting the metal working element with a water-based composition comprising an effective corrosion inhibiting amount of a concentrate comprising:

A. 2-heptyl-1-ethoxypropionic acid imidazoline, sodium salt in an amount of at least about 2 wt %;

B. triethanolamine is an amount of about 20 to 27 wt %; and

C. the triethanolamine salt of a dicarboxylic acid selected from the group consisting of a linear $C_8$ to $C_{14}$ dicarboxylic acid and mixtures thereof in an amount such that the weight ratio of triethanolamine salt to triethanolamine is about 4:8.

18. The metal machining process of claim 17 wherein the concentrate additionally comprises a polyethoxylated nonylphenol.

* * * * *

UNITED STATES PATENT AND TRADEMARK OFFICE

CERTIFICATE OF CORRECTION

PATENT NO. : 4,631,139

DATED : December 23, 1986

INVENTOR(S) : James Robert Burton and David Joseph Kushner

It is certified that error appears in the above-identified patent and that said Letters Patent is hereby corrected as shown below:

In Claim 10, line 15, delete "amine" second occurrence.

Signed and Sealed this

Seventeenth Day of March, 1987

*Attest:*

DONALD J. QUIGG

*Attesting Officer*

*Commissioner of Patents and Trademarks*